US008006975B2

(12) United States Patent
Müller et al.

(10) Patent No.: US 8,006,975 B2
(45) Date of Patent: Aug. 30, 2011

(54) METHOD AND APPARATUS FOR CONVEYING A SHEET BACK INTO THE OVERLAPPING STREAM IN THE EVENT OF A MACHINE STOP

(75) Inventors: Andreas Müller, Heidelberg (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 12/558,626

(22) Filed: Sep. 14, 2009

(65) Prior Publication Data

US 2010/0066007 A1 Mar. 18, 2010

(30) Foreign Application Priority Data

Sep. 12, 2008 (DE) ..... 10 2008 047 264

(51) Int. Cl.
*B65H 9/04* (2006.01)

(52) U.S. Cl. ..... 271/253; 271/237; 271/230; 271/216; 198/418.9; 198/419.1; 198/459.6

(58) Field of Classification Search ..... 271/237, 271/149, 159, 216, 229–231, 253–255, 225, 271/184, 902, 280; 198/418.9, 419.1, 459.6
See application file for complete search history.

(56) References Cited

U.S. PATENT DOCUMENTS

2004/0178567 A1 9/2004 Edinger

FOREIGN PATENT DOCUMENTS

| | | | |
|---|---|---|---|
| DE | 10 2004 007 404 | A1 | 9/2004 |
| DE | 10 2007 009 676 | A1 | 9/2008 |
| DE | 102007009676 | A1 * | 9/2008 |
| EP | 1 281 647 | B1 | 2/2003 |
| JP | 2003104582 | A * | 4/2003 |

* cited by examiner

*Primary Examiner* — Gerald W McClain
(74) *Attorney, Agent, or Firm* — Laurence A. Greenberg; Werner H. Stemer; Ralph E. Locher

(57) ABSTRACT

A method and an apparatus are provided to convey and align sheets being fed to a processing machine. In the event of a machine "stop," a sheet, which has been separated from an overlapping stream, is conveyed back into the overlapping stream by raising the rear sheet edge with a mechanical or pneumatic device.

6 Claims, 5 Drawing Sheets

METHOD AND APPARATUS FOR CONVEYING A SHEET BACK INTO THE OVERLAPPING STREAM IN THE EVENT OF A MACHINE STOP

CROSS-REFERENCE TO RELATED APPLICATION

This application claims the priority, under 35 U.S.C. §119, of German Patent Application DE 10 2008 047 264.6, filed Sep. 12, 2008; the prior application is herewith incorporated by reference in its entirety.

BACKGROUND OF THE INVENTION

Field of the Invention

The invention relates to a method and an apparatus for feeding sheets to a sheet processing machine, in particular a printing press.

In such a method and apparatus, the sheets are fed in an overlapping manner to an accelerating station, with which they are aligned and accelerated to processing speed.

In that case, sensors which are provided detect the position of the sheet. The positional data of the sheet are fed to a machine controller which determines the correction data from a setpoint/actual value comparison and transmits the correction data to actuating motors or drive motors of the accelerating station. If the necessary correction value lies above a permissible magnitude, a faulty sheet is identified.

It is known, for example, from European Patent EP 1 281 647 B1 that a sheet which has been identified as a faulty sheet is stopped by deceleration of a transport belt which transports the sheet in the overlapping stream, thereupon is moved back by a defined amount and is restarted with a predefined acceleration profile after the fixed position has been reached.

In the case of sheets which initially have been transported in an overlapping stream and subsequently have been separated for alignment and acceleration, there is the problem, however, that the rear sheet edge has left the overlapping stream, as a result of which a reverse movement of the sheet would lead to a collision between the rear sheet edge of the faulty sheet and the front edge of the following sheet.

SUMMARY OF THE INVENTION

It is accordingly an object of the invention to provide a method and an apparatus for feeding sheets to a processing machine, which overcome the hereinafore-mentioned disadvantages of the heretofore-known methods and apparatuses of this general type and through the use of which a sheet can be conveyed back into the region of an overlapping stream.

With the foregoing and other objects in view there is provided, in accordance with the invention, a method for conveying sheets to a processing machine. The method comprises conveying the sheets in a feeder in an overlapping stream, feeding sheets separated out of the overlapping stream to an aligning and accelerating station disposed in a feed plane, and when the feeder is stopped, conveying a sheet back onto the sheet stream, before conveying the sheet to the aligning and accelerating station again when the feeder is restarted.

With the objects of the invention in view, there is also provided an apparatus for conveying sheets to a processing machine having a feeder with a transport station for overlapping transport of sheets. The apparatus comprises an aligning and accelerating station disposed downstream of the transport station, and a pneumatically or mechanically acting raising apparatus, disposed between the transport station and the aligning and accelerating station, for a rear edge of the sheets.

In accordance with another feature of the invention, the rear sheet edge is raised up while the sheet is being moved backward and can be placed onto the overlapping stream in this way.

In accordance with a further feature of the invention, one preferred apparatus for raising up the rear sheet edge includes a guiding flap which is disposed in the plane of the feed table, lies in the plane of the feed table during feed operation of the sheets and can be pivoted out of the plane while the sheet is being moved backward.

In accordance with a concomitant feature of the invention, an apparatus for raising up the rear sheet edge can also be disposed above the sheet as a gripper device or can include a pneumatic device.

Other features which are considered as characteristic for the invention are set forth in the appended claims.

Although the invention is illustrated and described herein as embodied in a method and an apparatus for feeding sheets to a processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
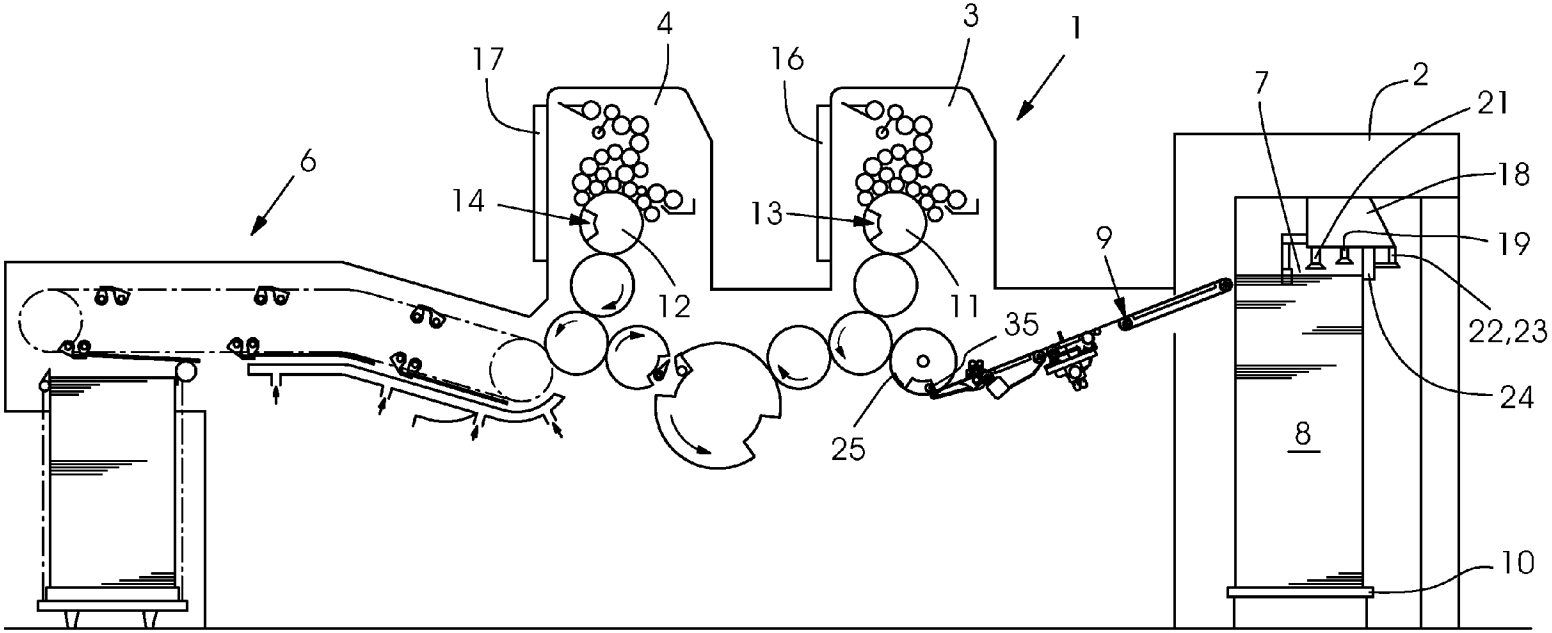
FIG. 1 is a diagrammatic, longitudinal-sectional view of a sheet-fed rotary printing press.

Referring now to the figures of the drawings in detail and first, particularly, to FIG. 1 thereof, there is seen a machine for processing sheets 7, for example a printing press 1, which has a feeder 2, at least one printing unit 3, 4 and a delivery 6. The sheets 7 are removed from a sheet stack 8 and are fed to the printing units 3, 4 in an overlapping manner over a feed table 9. The printing units 3, 4 each include a plate cylinder 11, 12 in a known manner. The plate cylinders 11, 12 each have an apparatus 13, 14 for fastening flexible printing plates. Moreover, each plate cylinder 11, 12 is assigned an apparatus 16, 17 for changing printing plates in a semiautomatic or fully automatic manner.

The sheet stack 8 rests on a stack board 10, which can be raised up in a controlled manner. The sheets 7 are removed from the upper side of the sheet stack 8 through the use of a so-called suction head 18 which has, inter alia, a number of lifting and dragging suckers 19, 21 for separating the sheets 7 and forming an overlapping or imbricated stream out of the sheets. Moreover, blowing devices 22 for loosening the upper sheet layers and sensing elements 23 for tracking the stack are provided. A number of lateral and rear stops 24 are provided for aligning the sheet stack 8, in particular the upper sheets 7 of the sheet stack 8.

As is seen in FIGS. 2-5, in order to transport the overlapping stream, the feed table 9 has at least one first transport belt 26 which is configured as a so-called "suction belt" and can preferably be driven synchronously with the sheet processing machine by a drive motor or by the feeder of the printing press.

Figure 2:
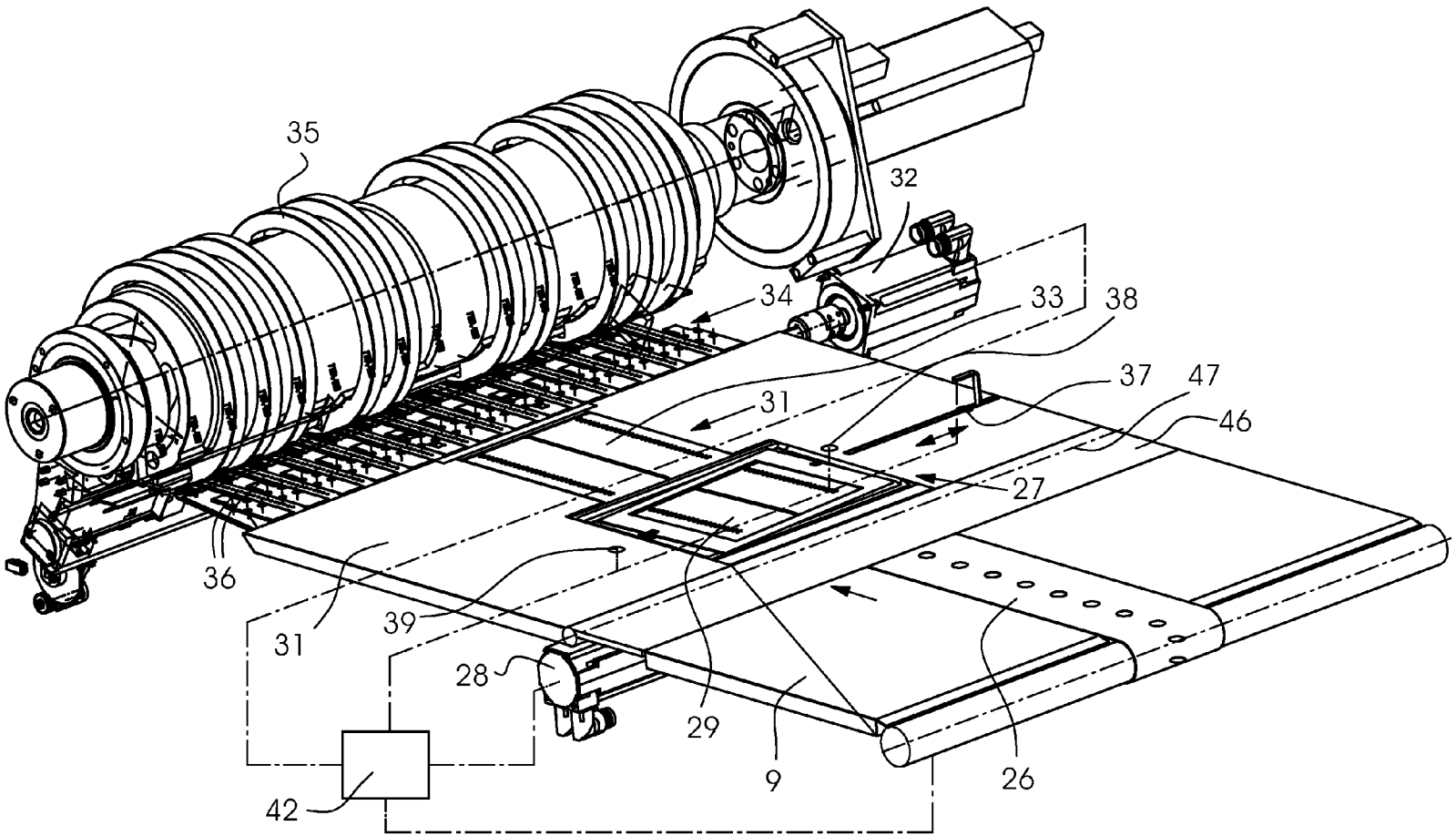
FIG. 2 is an enlarged perspective view of a feed device according to the invention.
Figure 3:
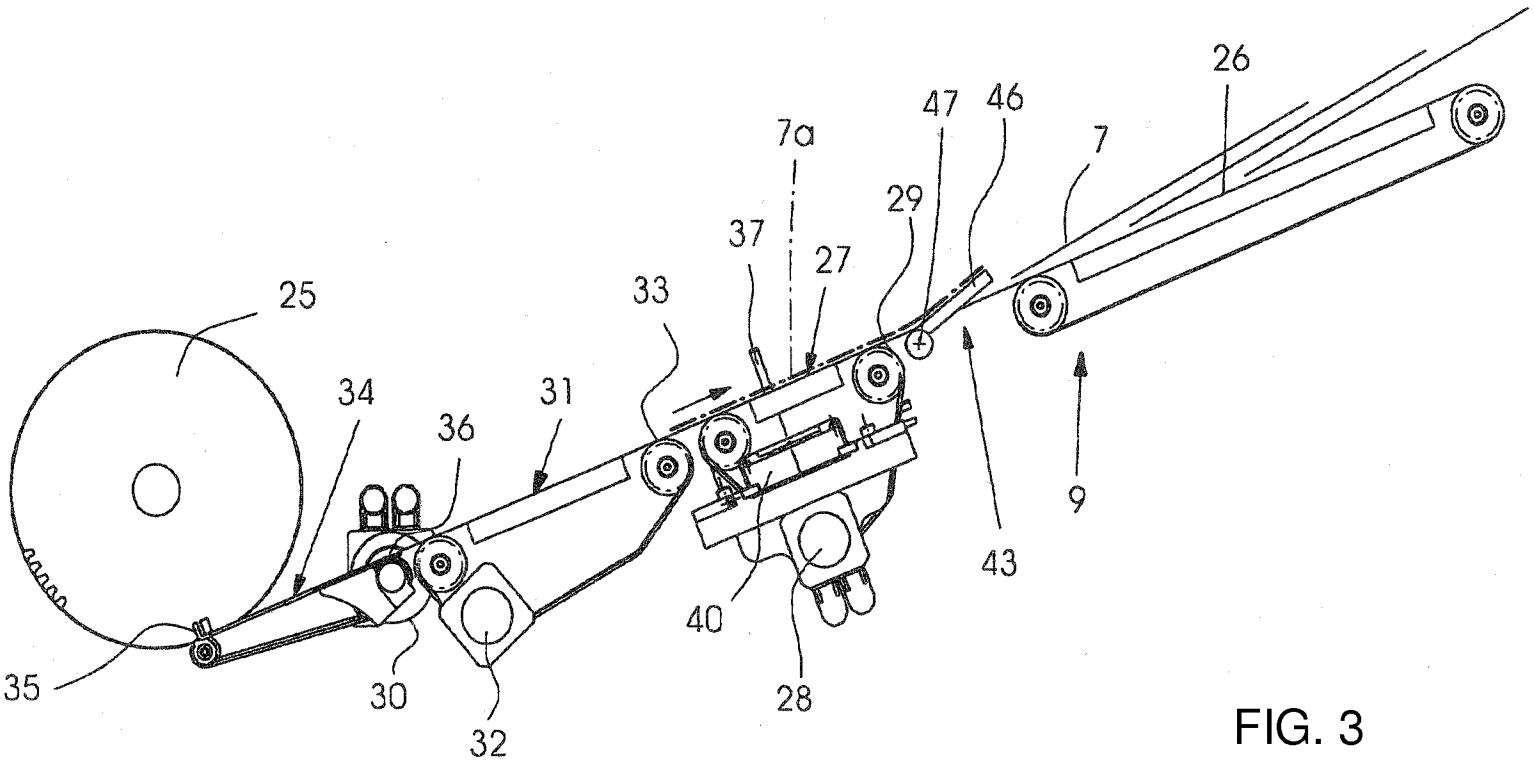
FIG. 3 is a longitudinal-sectional view of the feed device, with a guiding flap according to the invention.
Figure 4:
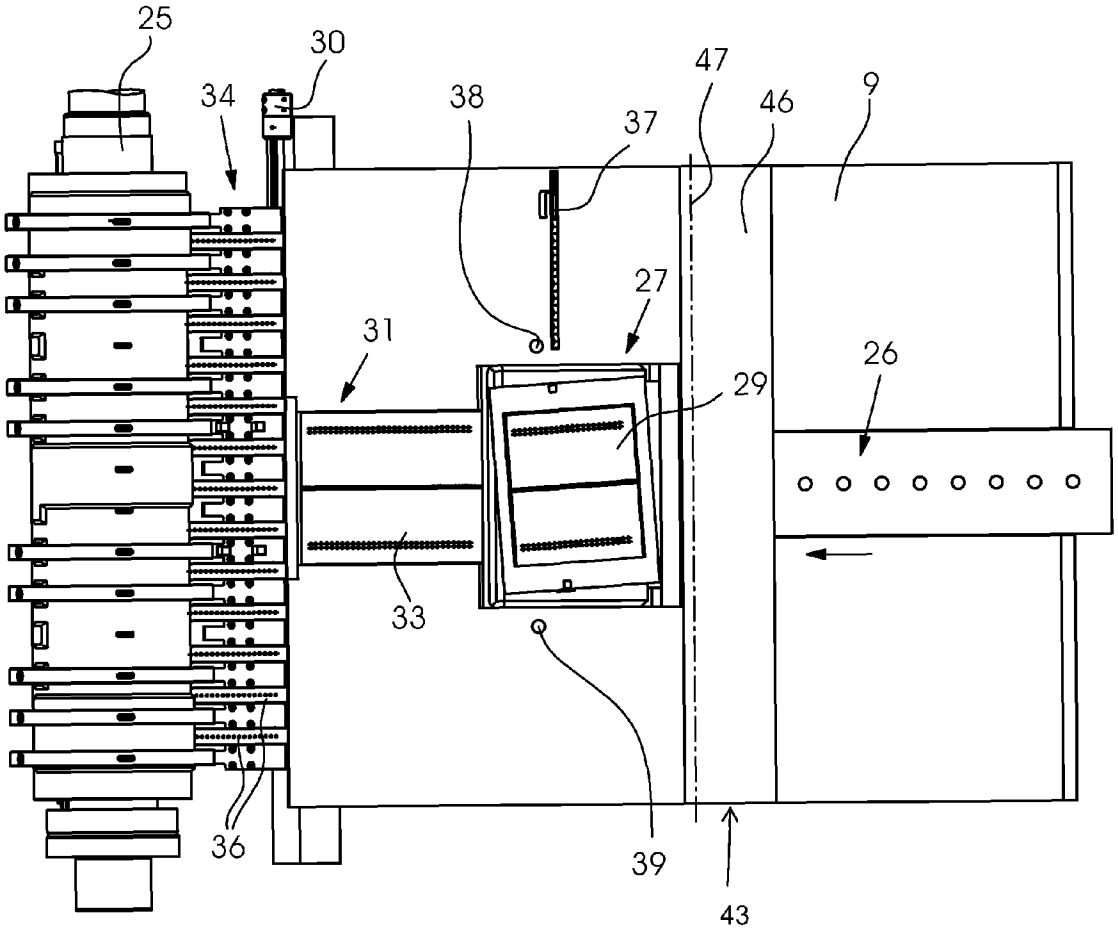
FIG. 4 is a plan view of the feed device.

A first accelerating station 27 is disposed behind the transport belt 26, in a sheet transport direction (indicated by an arrow in FIGS. 2, 3, 4). The first accelerating station 27 has a dedicated drive 28 which can be actuated independently of the drive of the transport belt 26. The accelerating station 27 has at least one transport belt 29 which is configured as a "suction belt" and can be loaded with vacuum as a function of the sheet which is to be accelerated.

At least one second accelerating station 31 is disposed behind the first accelerating station 27. The second accelerating station 31 has a drive 32 and includes substantially at least one transport belt 33 which can be loaded with vacuum.

A transport station 34, which is disposed behind the second accelerating station 31, has a number of suction belts 36 which are spaced apart next to one another, can be driven jointly through the use of a drive 30 at the speed of the sheet processing machine, and support and transport the sheet 7 to be fed over its entire width, until the latter is gripped by gripper devices 35 of a feed cylinder 25. The suction belts 36 can be loaded jointly with vacuum and it is possible for the loading with vacuum to be controlled synchronously with the sheet processing machine.

The transport belt 29 of the first accelerating station is configured in such a way that it can be adjusted obliquely and displaced laterally, in order to align the sheet 7 to be fed.

In order to grip a side edge of the sheet 7, a sensor 37 is provided which can be set to the transverse format to be processed and is disposed in the region of the first aligning station 27 in the sheet transport direction.

Two further sensors 38, 39 detect the front or leading sheet edge of the sheet 7 approximately at the same height and at the same instant as the sensor 37 and, after a setpoint/actual value comparison, control a drive 40 for the oblique position of the transport belt 29 and/or the accelerating station 27. The lateral position of the transport belt 29 and/or the accelerating station 27 is corrected by using a setpoint/actual value comparison of position values of the sheet which are determined through the use of the sensor 37.

After the sheet has been accelerated in comparison with the speed in the overlapping stream and has been aligned, it is gripped by a further (second) accelerating station 31 and is accelerated to machine speed.

The transport station 34, which is driven at machine speed, is disposed behind the further accelerating station 31 or further accelerating stations. The transport station 34 includes a number of the transport belts 36 which are spaced apart next to one another and are distributed in the feed table 9 over the maximum format width which can be processed. The transport belts 36 grip the sheet over its entire width and condition or homogenize it, as a result of which the sheet 7 can be transferred without stress to the gripper device 35 of the feed cylinder 25.

If, during a setpoint/actual value comparison, a correction value which has exceeded a predefined limiting value is determined by a machine controller 42, as a result of which the sheet cannot be corrected sufficiently by the aligning device, the sheet 7 is identified as a faulty sheet. In this case, the feeder drive is stopped, that is to say the feeder is at a standstill, while the printing press or the printing units continues or continue to rotate. In order to ensure that the feeder 2 can be engaged at as high a machine speed as possible during restarting, a sheet 7*a* which has already been separated out of the overlapping stream has to be transported back into the sheet stream, in order to ensure that it has a sufficiently large path available to accelerate to machine speed. In order to ensure that the rear or trailing edge of the sheet 7*a* does not collide with the front edge of the first sheet 7 of the sheet stream, that rear edge is raised up and placed onto the overlapping stream over the front edge of the sheet 7.

In one preferred embodiment according to FIGS. 3 and 4, a raising apparatus 43 is provided which includes a pivotable flap 46 that is disposed in the feed plane. During disruption-free machine operation, the flap 46 is disposed as a guide plane in the feed plane. The flap 46 is mounted in such a way that it can be pivoted out of the feed plane about a pin 47 which is disposed transversely with respect to the sheet transport direction, as a result of which it acts like a ramp, on which the sheet 7*a* that is to be transported back onto the overlapping stream can slide onto the overlapping stream.

Figure 5:
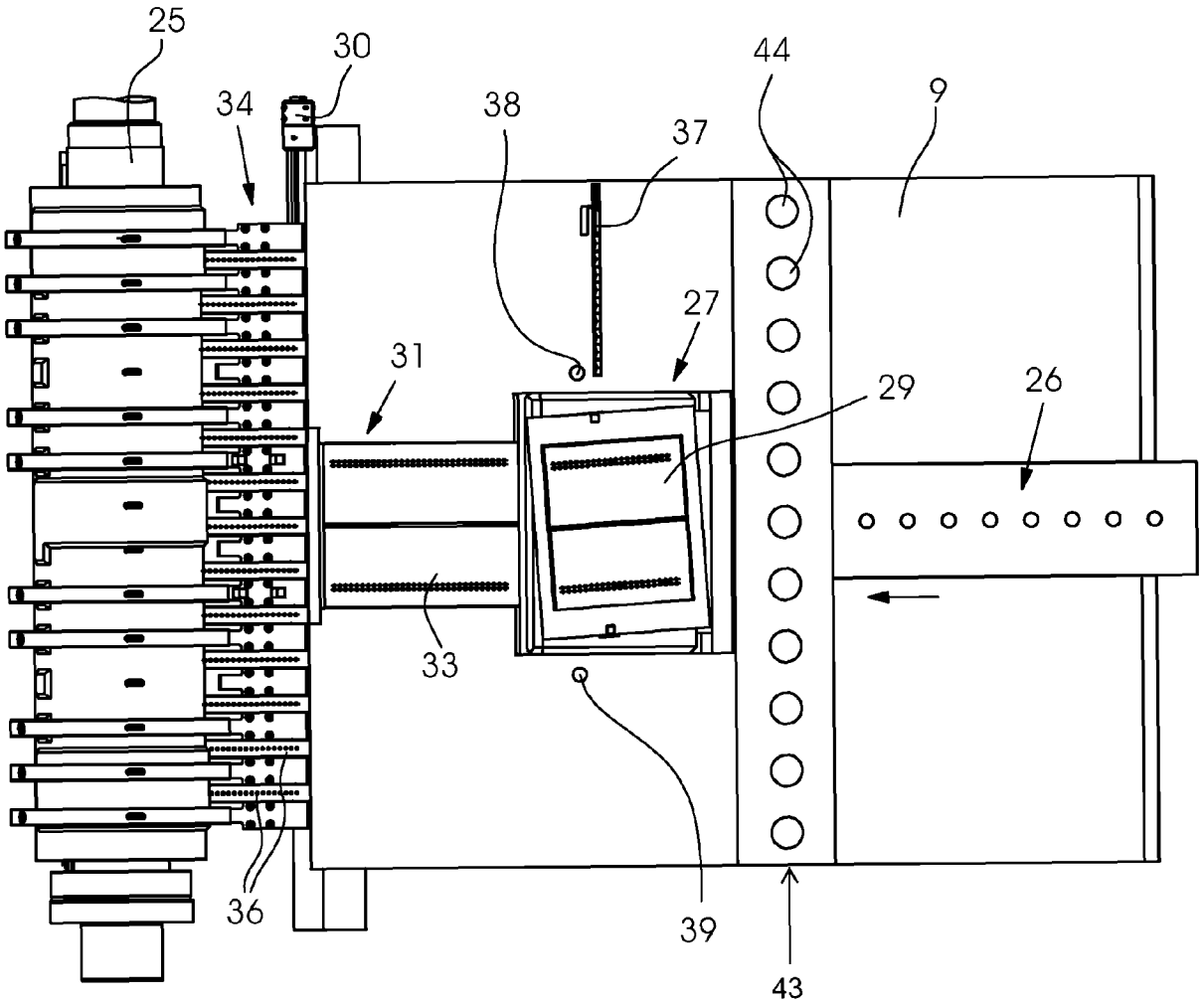
FIG. 5 is a plan view of a second exemplary embodiment with blower nozzles.

In another exemplary embodiment according to FIG. 5, a raising apparatus 43 is provided for raising the rear sheet edge of the sheet 7*a*. The raising apparatus 43 is disposed between the transport belt 26 for the overlapping sheet stream and the transport belt 29 for aligning the separated sheet and extends transversely with respect to the sheet transport direction. The raising apparatus 43 substantially includes a number of blower nozzles 44 which raise the sheet 7*a* through the use of blown air jets that are directed onto the underside of the sheet 7*a*. The sheet 7*a* is pushed back onto the overlapping stream by a reverse movement of the transport device 36, 33, 29.

The invention claimed is:

1. An apparatus for conveying sheets to a processing machine having a feeder with a transport station for overlapping transport of sheets, the apparatus comprising:

an aligning and accelerating station is disposed downstream of the transport station;

a pneumatically or mechanically acting raising apparatus, disposed between the transport station and said aligning and accelerating station, for a rear edge of the sheets; and a transport device controlled to move in reverse while said raising apparatus is actuated.

2. The apparatus according to claim 1, wherein said raising apparatus includes a number of blower nozzles disposed next to one another transversely to a sheet transport direction; and said blower nozzles are controlled to blow air jets while said transport device moves in reverse.

3. The apparatus according to claim 1, wherein said raising apparatus includes a pivotable flap disposed in a feed plane transversely to a sheet transport direction; and said pivotable flap is controlled to raise while said transport device moves in reverse.

4. A method for conveying sheets to a processing machine, the method comprising the following steps:

conveying the sheets in a feeder in an overlapping stream;

separating sheets out of the overlapping stream and feeding the separated sheets to an aligning and accelerating station disposed in a feed plane;

stopping the feeder; and while the feeder is stopped, conveying a sheet back onto the overlapping stream by raising up a rear sheet edge of the sheet while conveying the sheet backward; and after the sheet has been conveyed back onto the overlapping stream, restarting the feeder and conveying the sheet to the aligning and accelerating station.

5. The method according to claim 4, which further comprises carrying out the step of raising up the rear sheet edge mechanically.

6. The method according to claim 4, which further comprises carrying out the step of raising up the rear sheet edge pneumatically.

* * * * *